United States Patent [19]

Dicks

[11] Patent Number: 4,828,212

[45] Date of Patent: May 9, 1989

[54] MEANS FOR ADJUSTING THE VERTICAL HEIGHT OF THE SEAT OF A CHAIR

[75] Inventor: Peter Dicks, Cambridge, Canada

[73] Assignee: Faultless Doerner Manufacturing Inc., Waterloo, Canada

[21] Appl. No.: 50,785

[22] Filed: May 18, 1987

[51] Int. Cl.[4] ..... A47C 3/24

[52] U.S. Cl. ..... 248/406.2; 297/348; 248/418

[58] Field of Search ..... 248/406.1, 406.2, 161, 248/404, 157, 418; 297/345, 347, 348, 349

[56] References Cited

U.S. PATENT DOCUMENTS

| | | | |
|---|---|---|---|
| 593,059 | 11/1897 | Sheriffs et al. | 248/406.1 |
| 2,058,451 | 10/1936 | Herold | 248/406.1 |
| 2,137,178 | 11/1938 | Merivarra | 248/418 X |
| 2,702,075 | 2/1955 | Richards | 248/418 X |
| 3,059,088 | 10/1962 | Lie | 248/161 |
| 3,870,271 | 3/1975 | Bowman | 297/349 X |
| 4,598,892 | 7/1986 | Franckowiak et al. | 297/348 X |

FOREIGN PATENT DOCUMENTS

| | | | |
|---|---|---|---|
| 800375 | 12/1968 | Canada | 248/406.1 |

*Primary Examiner*—Robert W. Gibson, Jr.
*Assistant Examiner*—Karen J. Chotkowski
*Attorney, Agent, or Firm*—Fetherstonhaugh & Co.

[57] ABSTRACT

This invention relates to a collet assembly for adjusting the height of a seat supported by a threaded seat-support spindle. The collet assembly comprises a resilient threaded collet sleeve having slits extending from the base of its threaded core to form resilient jaws and a bell surrounding the core. The assembly also includes a collet jaw seat having an internal tapered jaw seating surface supporting inwardly directed projections. The collet sleeve is threaded to the spindle and the jaw seat is pushed onto the spindle below the collet sleeve so that the jaws of the sleeve rest against the seating surface of the collet jaw seat and the projections on the seating surface project into the slits of the collet sleeve to prevent relative rotation between the sleeve and jaw seat. When the seat is unloaded the bell of the collet sleeve may be grasped by an operator to permit the spindle to be rotated with respect to the bell.

17 Claims, 2 Drawing Sheets

MEANS FOR ADJUSTING THE VERTICAL HEIGHT OF THE SEAT OF A CHAIR

This invention relates to a collet assembly for raising or lowering the height of a spindle-mounted seat on a chair.

Chairs with height adjustable seats on threaded spindles have been known for decades. The height of the seat which is rigidly fixed to a threaded support spindle is adjusted by threading its support spindle upwardly or downwardly with respect to the leg assembly. After the seat has been adjusted to the desired height, the vertical positioning of the spindle with respect to the leg assembly is locked by the weight of the occupant who is sitting in the chair.

In the past, the threaded support spindle has been threaded upwardly or downwardly through a bell seated on the leg assembly. By locking the spindle to the bell, the spindle is locked vertically. To achieve this end, the spindle has a longitudinally extending channel and the washer is annular with an inwardly projecting finger. The washer is configured to fit over the spindle with the inwardly extending finger fitting into the channel. The washer can be moved vertically with respect to the spindle but it cannot be rotated about the spindle because the inwardly extending finger prevents any such rotation. In use, the weight of the occupant bearing down on the seat forces the inner face of the bell against the face of the washer so that frictional locking between the two members is achieved. During occupancy of the chair, the bell is locked with respect to the washer and the washer is rotatably locked with respect to the spindle; the end result is that the bell is locked to the spindle and no vertical height adjustment is possible. To adjust the height of the chair, the chair must be unoccupied so that the bell can be moved relative to the washer.

There are several problems associated with this method of vertical adjustment and securement. Expensive machining is required to form the channel extending longitudinally in the spindle to accommodate the inwardly extending finger of the annular washer. Once formed, the channel structurally weakens the support spindle.

Another problem is that dimples have to be formed on the inner bell face that bears down on the washer so that the two faces lock together when a person occupies the chair and thereby exerts a downward force on the spindle and bell.

An object of this invention is to provide a vertical height adjustment means whereby a channel need not be formed in the seat support spindle.

Another object of the present invention is to provide a vertical lock means for a chair spindle that does not require expensive machining in its manufacture.

Another object of the present invention is to provide a vertical adjustment means that can easily be operated.

Another object of the present invention is to provide a vertical adjustment means for the support spindle that is locked by a weight exerted downwardly from above the height of the support spindle.

These and other objects will become apparent after the following description is read.

According to this invention there is provided a seat height adjusting collet assembly for a chair having a seat supported by a spindle and a chair base, comprising: a collet jaw seat for surrounding said spindle and for being supported by said chair base having an internal tapered jaw seating surface; an internally threaded collet sleeve for threading onto said spindle having a core with depending resilient jaws for surrounding said spindle and for abutting said jaw seating surface and a bell rigidly affixed to said core, said bell sized for grasping by an operator; whereby, when said seat is loaded, said jaws ride into said jaw seat along said jaw seating surface and deflect inwardly into locking engagement with said spindle and whereby when said seat is unloaded, said jaws move along said jaw seating surface and out of locking engagement with said spindle so that an operator may grasp said bell of said sleeve and rotate said spindle with respect to said sleeve in order to adjust the height of said chair.

According to another aspect of this invention there is provided a seat height adjusting collet assembly for a chair having a seat supported by a spindle and a chair base, comprising: a collet jaw seat for surrounding said spindle and for being supported by said chair base having an internal tapered jaw seating surface and supporting at least one inwardly directed key; an internally threaded collet sleeve for threading onto said seat spindle having depending resilient jaws for surrounding said spindle and for abutting said jaw seating surface and having at least one axially directed keyway for reception of said at least one key of said collet jaw seat; whereby, when said seat is loaded, ride into said collet jaw seat along said jaw seating surface and deflect inwardly into locking engagement with said spindle with said at least one key sliding in said at least one keyway and when said seat, having been loaded, is rotated, said at least one key and said at least one keyway co-operate to prevent relative rotation between said collet sleeve and said collet jaw seat.

This invention provides a means for adjusting the height of the seat relative to the leg assembly that automatically locks when the occupant sits in the chair because a downward force is thereby transferred onto the spindle and the sleeve of the collet assembly. This downward force causes the sleeve of the collet assembly to tighten against the spindle to present the vertical height of the seat from being changed until the seat again becomes unoccupied.

The invention will be fully understood after reading the following description given in conjunction with the drawings of a preferred embodiment in which.

Figure 2:
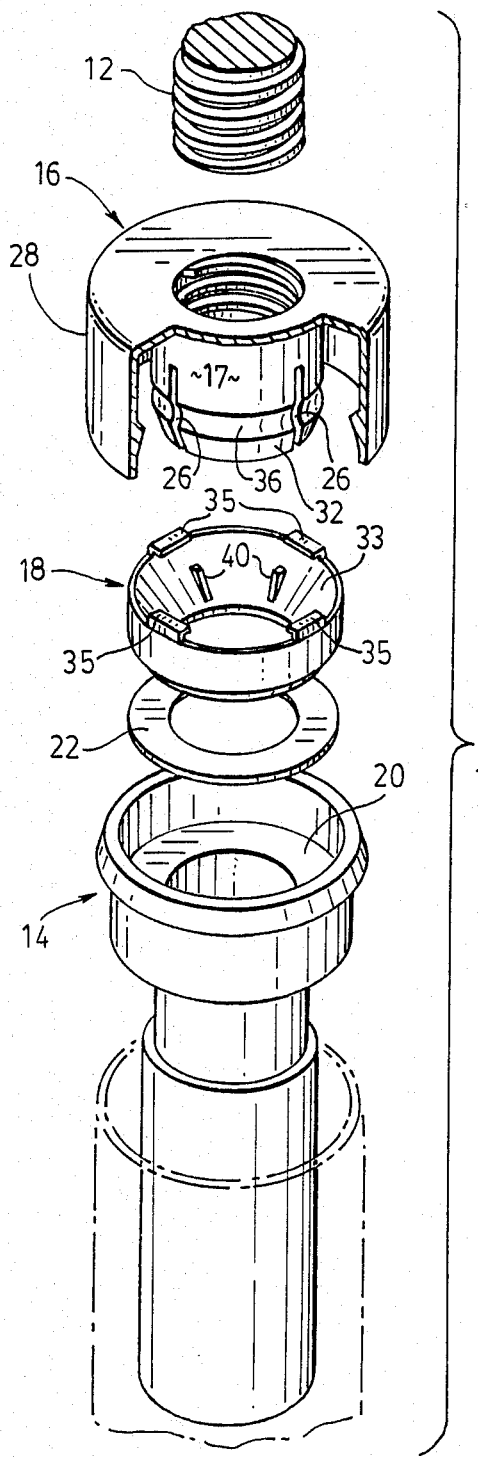
FIG. 2 is an exploded view showing the threaded collet and its component parts and its interrelationship with the leg assembly of the chair.
Figure 1:
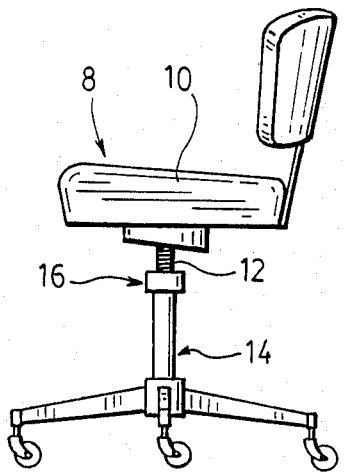
FIG. 1 is a side view of a chair having a threaded collet for adjusting the vertical height of the seat with respect to the leg assembly.
Figure 3:
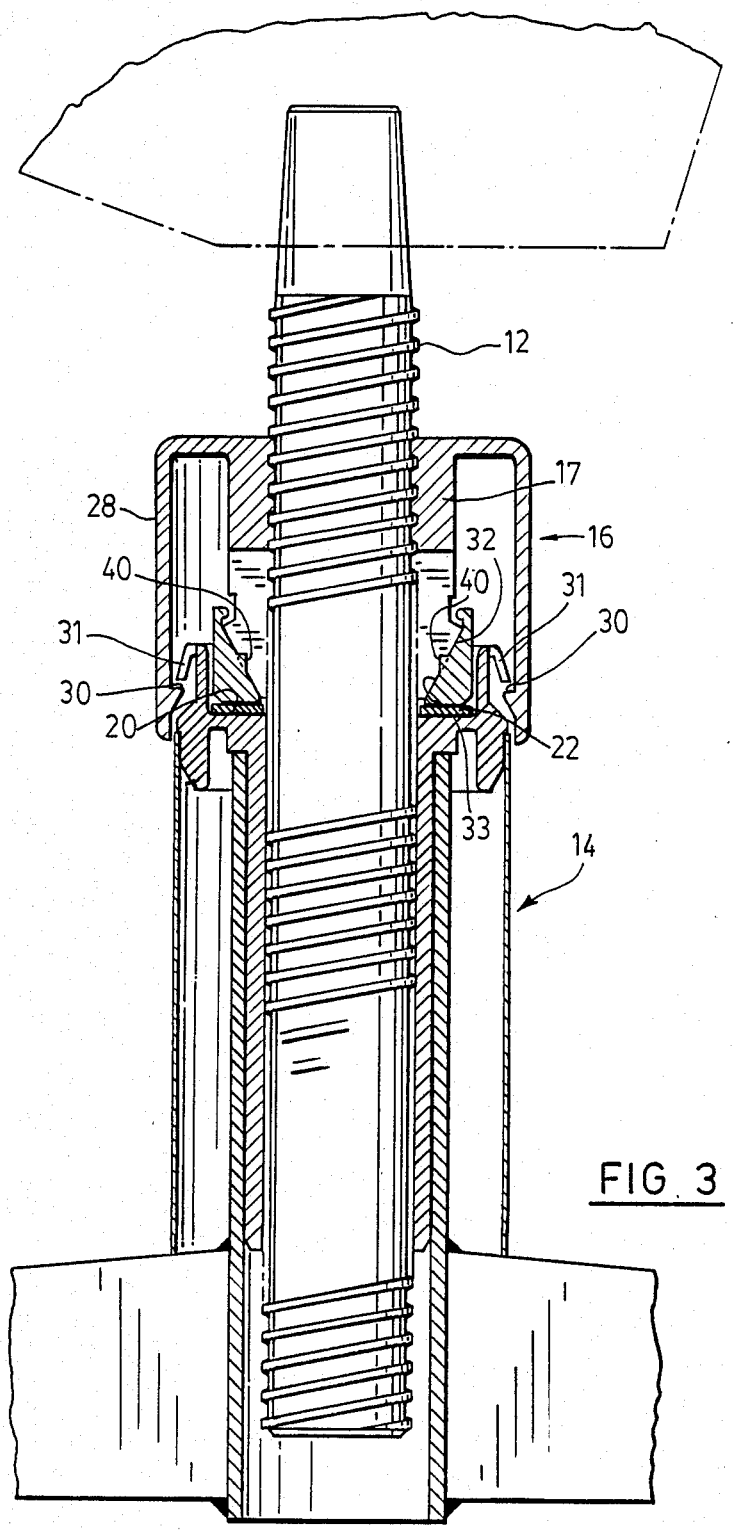
FIG. 3 is a cross-sectional view showing a spindle mounted in a threaded collet, the threaded collet being seated on the leg assembly of the chair.

Shown in FIG. 1 and, generally referred to by the numeral 8, is a chair for which this invention has application. The chair includes a seat 10, a threaded seat-support spindle 12 and a leg assembly, generally referred to by the numeral 14. The seat 10 is fixedly secured to the upper end of the threaded seat-support spindle 12. The seat support spindle 12 extends at its lower end into the cylindrical aperture 15 of the leg assembly and is mounted on the leg assembly by the collet assembly.

The vertical height of the seat 10 is adjusted and fixed by the collet assembly.

The collet assembly comprises a collet sleeve generally referred to by the numeral 16 and a collet jaw seat generally referred to by the numeral 18. The spindle is threaded upwardly or downwardly along the collet sleeve 16 to raise or lower the seat 10.

The collet assembly is seated at its jaw seat 18 on the leg assembly 14 with a washer 22 located therebetween. The leg assembly seat 20 upon which the jaw seat 18 sits preferably extends along a plane normal to the longitudinal axis of the spindle 12.

The collet sleeve 16, includes a core portion 17 having a threaded annular aperture extending therethrough so that the collet assembly can be threaded onto the seat support spindle 12. When the collet sleeve 16 is prevented from rotating with respect to the spindle, the height of the chair seat 10, with respect to the leg assembly is thereby locked.

The collet sleeve at its threaded core portion 17 includes slits 26 extending upwardly from its bottom edge to provide the lower end of the collet sleeve with resilient movement in the radial direction. The slits 26 permit the lower edge of the collet sleeve to move radially inwardly to lock the collet sleeve against the support spindle 12 and radially outwardly to release the collet sleeve from the support spindle 12.

The collet sleeve 16 preferably includes a bell 28 radially spaced from the inner threaded core 17. The bell 28 has an inwardly extending flange 30 on its inner surface to prevent the collet assembly from dismounting from the leg assembly. The flange 30 will catch against flange 31 of the leg assembly to prevent the collet assembly from being inadvertently lifted upwardly off of the leg assembly.

In this embodiment illustrated, the collet sleeve is made from a resilient plastics material and can be made from a single molding operation. The collet sleeve, being the member that tightens against the spindle, must be made from a resilient material so that it reasserts itself to unlock the collet assembly from the spindle when the chair is not occupied.

Adjacent the lower edge of the inner core portion 17 of the collet sleeve is a sloped seating surface 32 which, in use sits on a sloped seat 33 of the collet jaw seat 18. When the spindle is pressed downwardly, the sloped seating surface 32 is forced to ride inwardly and the lower edge of the core portion of the collet sleeve tightens against the support spindle 12 to thereby lock the collet assembly to the support spindle.

The collet jaw seat 18 is mounted to the collet sleeve 16 by fitting its radially inwardly projecting flanges 35 into the circumferential channel 36 formed on the outer surface of the core portion 17. The collet jaw seat 18 also includes inwardly extending projection 40 which fit into the upper portion of the slits 26 of the collet sleeve 16 and prevent any relative rotational movement of the collet jaw seat with respect to the collet sleeve 16.

As aforementioned, the collet jaw seat 18 has an inner annular aperture with a sloped seat 33 formed thereon. The sloped seat 33 extends radially outwardly and upwardly with respect to the spindle 12. The sloped seat 33 provides a guiding and sliding surface for the sloped seating surface 32 of the collet sleeve 16 to, in use, guide the lower portion of the collet sleeve downwardly and inwardly when a weight is exerted downwardly on the seat of the chair.

Preferably, the collet bushing is made from a plastics material in a single molding operation but other materials and methods of manufacture, which will be known by those skilled in the art, can also be used.

In use, when one wishes to raise the vertical height of the seat, they turn the collet assembly sleeve about the threaded spindle 12 when the chair is unoccupied. This threads the spindle 12 upwardly or downwardly with respect to the leg assembly 14.

When a person sits in the chair, their weight exerts a downward force on the seat 10 and the spindle 12. This downward force is transferred from the seat 10 to the spindle 12 and the spindle 12 carries the collet sleeve 16 downwardly along the sloped seat 33 of the jaw seat. Because the collet sleeve is made from a resilient plastics material, the lower edge of the core portion 17 is forced by the slope of the seat 33 of the jaw seat to bend radially inwardly and tighten against the support spindle 12. Any relative movement between the collet sleeve and the support spindle 12 is thereby prevented by the downwardly exerted force.

It is not possible to adjust the vertical height of the seat 10 when a person is sitting in the chair because the core portion 17 is tightened against the spindle 12. The vertical height of the seat 10 of the chair is therefore automatically locked when a person sits in the chair and will remain locked for as long as the person sits in the chair.

When a person gets up out of the chair, the resiliency of the collet sleeve 16 causes the inner core portion 17 to reassert itself to its original shape and untighten from the spindle. When the core portion 17 reasserts itself to its original shape, it's lower edge rises upwardly and radially outwardly along the sloped seat 33 of the collet jaw seat 18.

Those skilled in the art will appreciate that there are many modifications that can be made within the scope of this invention to the threaded collet assembly illustrated. It will also be apparent that the bell 28 of the collet sleeve is not essential to all aspects of this invention and that the aperture of the collet jaw seat need not be annular so long as it is located about the spindle and provides a seat for the sleeve.

This invention provides a height adjustment means whereby a channel need not be formed in the seat support spindle and the assembly can be inexpensively manufactured. The vertical adjustment means can be easily operated and is locked by the weight of the occupant sitting in the chair.

It is not intended that the scope of protection be restricted to the preferred embodiment illustrated but extend to the invention as a whole as described in this specification and claimed in the appended claims.

I claim:

1. A seat height adjusting collet assembly for a chair having a seat supported by a spindle and a chair base, comprising:

(a) a collet jaw seat for surrounding said spindle and for being supported by said chair base having an internal tapered jaw seating surface and supporting at least one inwardly directed key;

(b) an internally threaded collet sleeve for threading onto said seat spindle having depending resilient jaws for surrounding said spindle and for abutting said jaw seating surface and having at least one axially directed keyway for reception of said at least one key of said collet jaw seat;

whereby, when said seat is loaded, said jaws ride into said collet jaw seat along said jaw seating surface and deflect inwardly into locking engagement with said spindle with said at least one key sliding in said at least one keyway and when said seat, having been loaded, is rotated, said at least one key and said at least one keyway co-operate to prevent relative rotation between said collet sleeve and said collet jaw seat.

2. The seat height adjusting collet assembly of claim 1 wherein said collet sleeve includes a circumferential notch and wherein said collet jaw seat includes inwardly directed flanges for seating in said notch to impede axial withdrawal of said collet sleeve from said collet jaw seat and to maintain said at least one key in said keyway.

3. The seat height adjusting collet assembly of claim 2 further including:

(c) a washer for interposition between said collet jaw seat and said chair base for forming a bearing surface for said collet jaw seat.

4. The seat height adjusting collet assembly of claim 2 wherein said collet sleeve includes a depending bell having an inwardly directed flange for co-operating with an outwardly directed flange on said chair base to impede the dismounting of said collet assembly from said chair base.

5. The seat height adjusting collet assembly of claim 4 wherein said bell is exposed so that an operator may grasp same to rotate said spindle with respect to said sleeve to adjust the height of said seat.

6. A seat height adjusting collet assembly for a chair having a seat supported by a spindle and a chair base, comprising:

(a) a collet jaw seat for surrounding said spindle and for being supported by said chair base having an internal tapered collet jaw seating surface and supporting at least one inwardly directed projection;

(b) an internally threaded resilient collet sleeve for threading onto said seat spindle and for being supported by said collet jaw seating surface having axially directed slits extending from its base forming resilient jaws, at least one of said slits receiving said at least one projection;

whereby, when said seat is loaded, said jaws ride into said jaw seat along said jaw seating surface and deflect inwardly into locking engagement with said spindle with said at least one projection sliding in at least one of said slits and whereby, when said seat, having been loaded, is rotated, said at least one projection and at least one of said slits co-operate to prevent relative rotation between said collet sleeve and said collet jaw seat.

7. The seat height adjusting collet assembly of claim 6 wherein said collet sleeve includes a circumferential notch and wherein said jaw seat includes inwardly directed flanges for seating in said notch to impede axial withdrawal of said collet sleeve from said collet jaw seat and to maintain said at least one projection in at least one of said slits.

8. The seat height adjusting collet assembly of claim 7 further including:

(c) a washer for interposition between said collet jaw seat and said chair base for forming a bearing surface for said collet jaw seat.

9. The seat height adjusting collet assembly of claim 7 wherein said collet sleeve is formed integrally of a plastics material.

10. The seat height adjusting collet assembly of claim 7 wherein said collet sleeve includes a depending bell having an inwardly directed flange for co-operating with an outwardly directed flange on said chair base to impede the dismounting of said collet assembly from said chair base.

11. The seat height adjusting collet assembly of claim 10 wherein said bell is exposed so that an operator may grasp same to rotate said spindle with respect to said sleeve to adjust the height of said seat.

12. The seat height adjusting collet assembly of claim 6 wherein said collet sleeve is formed integrally of a plastics material.

13. A seat height adjusting collet assembly for a chair having a seat supported by a spindle and a chair base, comprising:

(a) a collet jaw seat for surrounding said spindle and for being supported by said chair base having an internal tapered jaw seating surface, (b) an internally threaded collet sleeve for threading onto said seat spindle having a core with depending resilient jaws for surrounding said spindle and for abutting said jaw seating surface and a bell rigidly affixed to said core, said bell sized for grasping by an operator, (c) said collet sleeve being resilient and having axially directed slits extending from the base of its core forming said depending resilient jaws, (d) said collet jaw seat supporting at least one inwardly directed projection and wherein at least one of said slits of said collet sleeve receives said at least one projection whereby, when said seat is loaded, said jaws ride into said jaw seat along said jaw seating surface and deflect inwardly into locking engagement with said spindle and whereby when said seat is unloaded, said jaws move along said jaw seating surface and out of locking engagement with said spindle so that an operator may grasp said bell of said sleeve and rotate said spindle with respect to said sleeve in order to adjust the height of said chair.

14. The seat height adjusting collet assembly of claim 13 wherein said collet sleeve includes a circumferential notch and wherein said jaw seat includes inwardly directed flanges for seating in said notch to impede axial withdrawal of said collet sleeve from said collet jaw seat and to maintain said at least one projection in at least one of said slits.

15. The seat height adjusting collet assembly of claim 14 further including:

(c) a washer for interposition between said collet jaw seat and said chair base for forming a bearing surface for said collet jaw seat.

16. The seat height adjusting collet assembly of claim 14 wherein said bell has an inwardly directed flange for co-operating with an outwardly directed flange of said chair base to impede the dismounting of said collet assembly from said chair base.

17. The seat height adjusting collet assembly of claim 13 wherein said collet sleeve is formed integrally of a plastics material.

* * * * *